US008870715B2

(12) United States Patent
Stiles

(10) Patent No.: US 8,870,715 B2
(45) Date of Patent: Oct. 28, 2014

(54) KNEE EXERCISER

(76) Inventor: Michelle Stiles, Elma, NY (US)

( * ) Notice: Subject to any disclaimer, the term of this patent is extended or adjusted under 35 U.S.C. 154(b) by 148 days.

(21) Appl. No.: 12/859,452

(22) Filed: Aug. 19, 2010

(65) Prior Publication Data

US 2011/0046525 A1 Feb. 24, 2011

Related U.S. Application Data

(60) Provisional application No. 61/235,066, filed on Aug. 19, 2009.

(51) Int. Cl.
*A63B 21/00* (2006.01)

(52) U.S. Cl.
USPC ..... 482/49; 482/907

(58) Field of Classification Search
USPC ..... 482/83–90, 66, 68, 107, 100, 121, 108, 482/49; 24/282, 279, 277, 1
See application file for complete search history.

(56) References Cited

U.S. PATENT DOCUMENTS 5,720,699 A * 2/1998 Musachio et al. ..... 482/122

* cited by examiner

*Primary Examiner* — Jerome w Donnelly
(74) *Attorney, Agent, or Firm* — Wilson Daniel Swayze, Jr.

(57) ABSTRACT

An apparatus for flexing the knee comprising a U-shaped bar having two straight arms each having a distal end and a handle portion generally perpendicular to the straight arms and a perpendicular cross-member adjustably attached to the straight arms; and a method for flexing the knee comprising the steps of providing a patient with device having a handle section and two parallel straight sections with a perpendicular cross-member attached to the straight sections, having the patient to place his or her foot onto the cross-member, and having the patient to pull the device toward the knee.

6 Claims, 6 Drawing Sheets

KNEE EXERCISER

PRIORITY

The present invention claims priority under 35 USC section 119 and is based on a provisional application which was filed on Aug. 19, 2009 with a serial number of 61/235,066

FIELD OF THE INVENTION

This invention relates generally to the fields of physical therapy and patient rehabilitation and, more specifically to physical therapy devices and methods for the knee.

BACKGROUND

Over one half million total knee replacement (TKR) surgeries are performed in the United States every year. This number is expected to grow to over three-and-a-half million surgeries by the year 2030. In recent years, significant progress has been made in the surgical procedure, surgical components, and approaches to rehabilitation. Initially, TKR patients were immobilized for 4 to 6 weeks following surgery because it was feared that early range of motion (ROM) movements would be harmful to the new joint. The result, however, was that regaining full ROM was extremely difficult after the knee was immobilized for one month. Nevertheless, for many severely afflicted individuals, this was felt to be an acceptable tradeoff for a pain free gait.

Gradually, medical practitioners began to recognize that early ROM was preferable and generated better results. Indeed, knee ROM was easier to restore and knee bend ranges were improved. To take advantage of this recognition, a continuous passive motion (CPM) machine was developed. The CPM machine uses a mechanical force to bend the knee through a set ROM at a set speed. The patient is required to lie supine with his or her leg strapped within a frame. The CPM machine is then anchored to a bed using straps which prevent movement and slippage away from the patient during use.

Eventually, studies were created to examine the effectiveness of patients themselves bending the knee (active ROM) as opposed to the CPM machine doing the bending. It was concluded that active and active assisted ROM by the patient was just as effective at restoring ROM as the CPM machine. Nevertheless, the CPM machine is still used by some physicians to encourage ROM very early post operative while the patient is physically or mentally unable to actively participate in the rehabilitation process. Presently, conventional wisdom is that early and frequent active and active assisted range of motion by the patient is the best and most cost effective way to regain range of motion post surgery. In comparing various exercise methods to enhance ROM, it has been suggested that the actual method used does not matter. Most patients who are initially slow to regain range eventually catch up at 6 months or one year and that quality of life measures are similar one year after surgery. However, patients who get ROM back quickly spend less time on pain medication, less time dealing with side effects of the pain medication (such as constipation, drowsiness, and fear of addiction), can engage in community activities sooner, and overall, feel better about the surgery. Additionally, patients who do not regain early range may gain adequate range (a 90 degree knee bend from a straight leg), but are unlikely to gain excellent range (bending a straight leg at the knee 120 degrees or more, or a complete bend). All patients, but especially taller patients (above six feet tall), will be hindered by a knee range of 90 degrees or less. This limited range can adversely affect patient activity levels, safety, and future independence.

Despite advances in approach and technique in patient rehabilitation following total knee replacement, TKR continues to have a reputation as being a "tough" surgery. There are multiple reasons for this. Assuming adequate pain management, the top two reasons for failure to regain knee range of motion in a timely manner are 1) insufficient bio-mechanical advantage, and 2) insufficient frequency of exercise.

Bio-mechanical advantage is important in rehabilitation following a TKR because the knee is swollen and stiff. Typically, the hamstring on the affected side has weakened prior to surgery and may not be able to overcome the tissue tightness in the knee following surgery. Ways to compensate for the weak pull of the hamstring include using the unaffected side to assist in flexing the surgical knee, using human power like a physical therapist or family member, and using tools to leverage the knee bend (such as stairs or a loose strap to pull the knee into flexion). Troubles occur when one or several ways are not available to the patient on a regular basis. For example, the non-surgical knee may not be pain-free and might be weak as well, thereby eliminating the bio-mechanical advantage. Using other humans is a method that forces the patient to be dependent on someone else. A physical therapist may only be available three times a week or family members may not be available for most of the day or may not be willing or capable to assist the patient. Frustration results as the patient cannot be self-determining in the course of his or her rehabilitation. Relying on a set of stairs for exercises presents numerous safety issues, such as the stairs being cluttered or the patient losing his or her balance.

Thus, it is readily apparent that there is a long-felt need for a knee exercising device and method, particularly for patients following a total knee replacement surgical procedure.

SUMMARY OF THE INVENTION

According to the present invention, a device and method is provided which meets the aforementioned requirements and needs. Specifically, the device according to the present invention provides a U-shaped bar having a curved or squared end serving as a handle portion and having two distal ends which are placed on the floor during use. A cross-member is positioned perpendicular and adjustably affixed to the parallel arms of the U-shaped bar or may be fixed to the parallel arms of the U-shaped bar. Threaded knobs are used to control lateral adjustment of the cross-member. In another embodiment, the device is roughly H-shaped wherein one pair of opposing ends of the parallel uprights serves as a pair of handles while the distal pair of opposing ends of the parallel uprights are placed on the floor during use. A cross-member is positioned perpendicular and adjustably affixed to the parallel arms of the H-shaped device. Threaded knobs are used to control lateral adjustment of the cross-member.

In operation, a user places the ball of his or her foot on the middle of the cross-member. The user then places both hands on the handle portion of the U-shaped bar, or along the straight portion of the U-shaped bar proximate the handle portion, or in another embodiment on the straight, opposing ends forming a handle portion of the H-shaped device. The user then slowly pulls the handle portion toward his or her knee until the knee is properly stretched. The proper stretch is a moderate intensity stretch wherein the user will feel some discomfort and a pulling feeling in the knee. Stretching too far will cause pain and the user to reflexively withdraw from the motion. Position of the cross-member is adjusted using a pair of threaded knobs. The position of the cross-member impacts the excursion of the foot backward and hence the bend in the knee. Raising the height of the cross-member (i.e. from proximate the terminus of the distal ends and closer to the floor, to closer to the handle end and further from the floor) increases the difficulty of the exercise by increasing the knee angle if the distance of the device from the user remains constant. Alternatively, the user can increase the knee angle by "walking" the device closer to his or her body. "Walking" entails the user lifting one distal end and replacing it on the floor closer to his or her body. He or she then repeats the process on the other distal end. Preferably, the user "walks" the device a distance equal to the width of the distal end portion of the U-shaped bar or H-shaped device. When a user is able to easily pull the handle to his or her knee, it is time to "walk" the device closer to the body. "Walking" the device allows the user to maintain the continuity of the exercise and increase the difficulty without the added need of having to change the cross-member height.

The knee flexing device according to the present invention is formed preferably as a steel or metal member which is U-shaped, having a curved or squared end serving as a handle portion and having two distal ends. The U-shaped steel member is preferably formed from hollow tubing having an outer diameter which has preferably been selected from a range of from one-half inch to one inch in diameter. The two distal ends are equipped with anti-slipping members, preferably rubber feet or a pivoting foot having a rubber base. A cross-member is adjustably positioned between the distal ends of the U-shaped steel member. Although the cross-member can have any cross sectional shape, including but not limited to round, oval, hexagonal, or triangular, the preferred shape is square. The cross-member is preferably formed from square hollow tubing which has preferably been selected from a range of one-half inch to one inch. The cross-member is preferably coated with a non-slip surface to prevent a user's foot from slipping off of the cross-member during use. The square shaped cross-member is adjustably affixed to the U-shaped member through a pair of round tubular attachments. The round tubular attachment is preferably formed from hollow steel tubing having an inner diameter sufficient to fit snuggly around the distal ends of the U-shaped member. The cross-member is permanently affixed to the round tubular attachments, preferably by a weld. A hole is drilled through the side of the round tubular attachment opposite the connection point of the cross-member. A steel nut is welded to the attachment such that the threaded hole of the nut is in communication with the drilled hole on the attachment. A bolt having a user-friendly knob is threaded into the welded nut. When tightened into the nut, the bolt applies pressure to the outer wall of the U-shaped member. The applied pressure holds the cross-member in place and prevents it from slipping when in use.

In another embodiment, the device is roughly H-shaped. The handle portion of the U-shaped bar of the earlier embodiment is replaced with two opposing handles. The handles form the upright of the H-shape. The opposing handles can be parallel with one another or positioned so that they are leaning toward one another to increase user comfort and ease. The two parallel members of the H-shaped device are preferably formed of hollow tubing steel or metal having an outer diameter which has preferably been selected from a range of from one-half inch to one inch in diameter. The two distal ends which rest on the floor during use are equipped with anti-slipping members, preferably rubber feet or a pivoting foot having a rubber base. The handle portions of the upright ends of the parallel members are equipped with improved gripping material such as rubber, formed plastic, or by having an etched surface. A cross-member is adjustably positioned between the parallel members of the H-shaped steel device. Although the cross-member can have any cross sectional shape, including but not limited to round, oval, hexagonal, or triangular, the preferred shape is square. The cross-member is preferably formed from square hollow tubing which has preferably been selected from a range of one-half inch to one inch. The cross-member is preferably coated with a non-slip surface to prevent a user's foot from slipping off of the cross-member during use. The square shaped cross-member is adjustably affixed to the parallel H-shaped members through a pair of round tubular attachments. The round tubular attachment is preferably formed from hollow steel tubing having an inner diameter sufficient to fit snuggly around the distal ends of the H-shaped members. The cross member is permanently affixed to the round tubular attachments, preferably by means of a weld. A hole is drilled through the side of the round tubular attachment opposite the connection point of the cross-member. A steel nut is welded to the attachment such that the threaded hole of the nut is in communication with the drilled hole on the attachment. A bolt having a user-friendly knob is threaded into the welded nut. When tightened into the nut, the bolt applies pressure to the outer wall of the H-shaped members. The applied pressure holds the cross-member in place and prevents it from slipping when in use.

It is the object of the present invention to provide a post-surgery exercise device to flex a joint.

Yet another object of the present invention is to provide a post-surgery exercise device which is easy and inexpensive to manufacture and use. Still another object of the present invention is to provide a post-surgery exercise device which is adjustable for different user sizes, strengths, and flexion abilities.

Yet still another object of the present invention is to provide a post-surgery exercise device for flexing a joint with the ability to control the range and speed of the flexing.

Other objects and advantages of the present invention will be more readily apparent from the following detailed description when read in conjunction with the accompanying drawings.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 1:
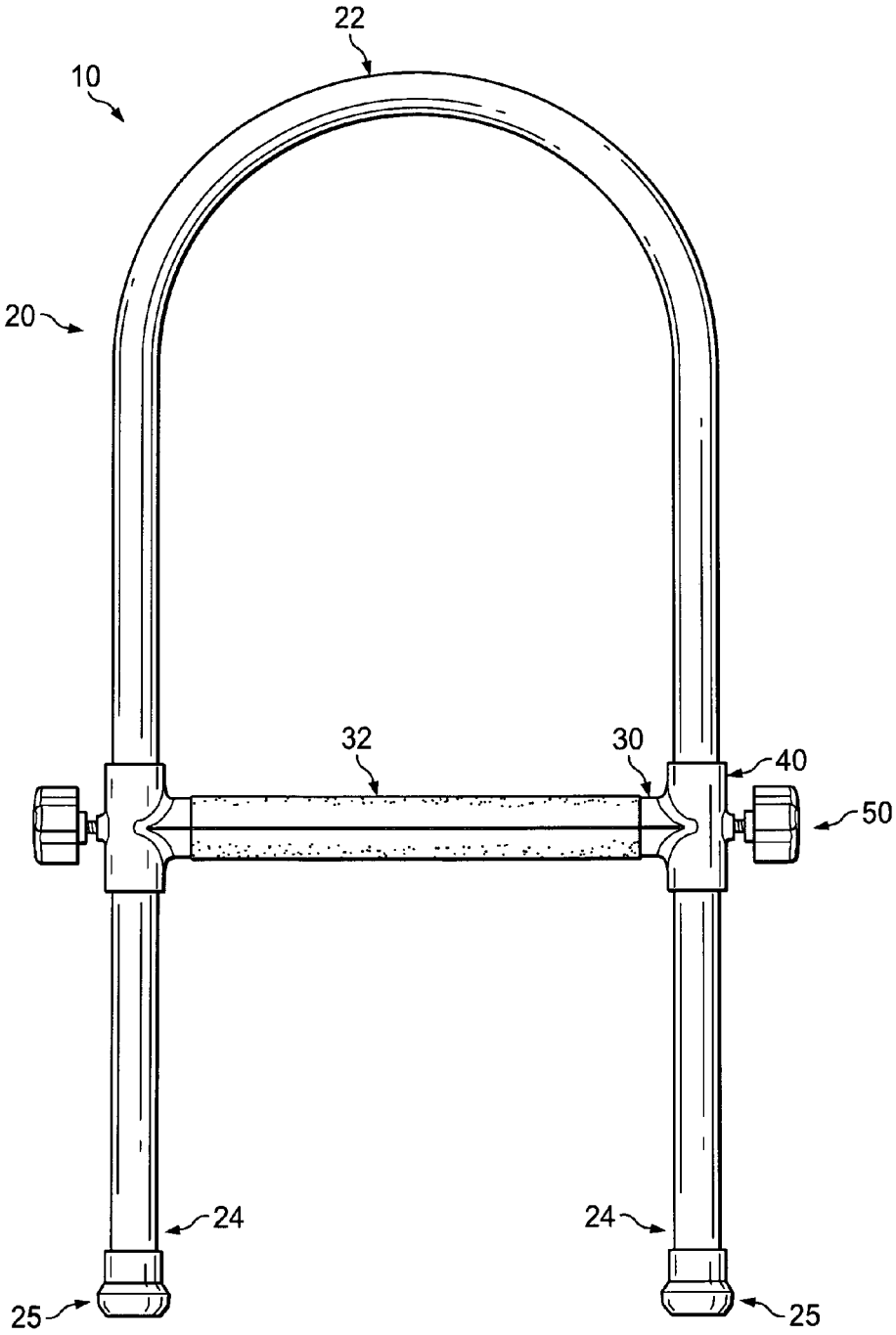
FIG. 1 is a side perspective view of an exercise device according to the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

A knee flexing device of the present invention is shown in FIG. 1. The knee flexing device 10 may include a U-shaped bar 20 having a curved or squared end 22 which may serve as a handle portion and may have two distal ends 24 which may be placed on the floor during use. The U-shaped bar 20 may have a first and a second armed portion which may be connected to a base portion. A cross-member 30 which may be square shaped may be positioned perpendicular to and may be adjustably and detachably affixed to the parallel arms or may be fixed to the of the U-shaped bar 20. Knobs 50 which may be threaded may be used to control lateral adjustment of cross-member 30.

The knee flexing device 10 according to the present invention may be formed preferably as a steel or metal member; however any rigid material can be used including wood or plastic such as PVC. The U-shaped member 20 which may be formed from steel may be preferably formed from hollow tubing which may have an outer diameter which may have been preferably selected from a range of from one-half inch to one inch in diameter, with one inch being preferred. The two distal ends 24 may be equipped with anti-slipping members, preferably rubber feet 25 or a pivoting foot having a rubber base (shown in FIG. 7). A cross-member 30 which may be square shaped may be adjustably positioned between the distal ends of the U-shaped member 20. The cross-member 30 may be preferably formed from rigid square hollow tubing such as steel, aluminum, wood, or a rigid plastic, and is preferably selected from a range of one-half inch to one inch and may correspond to the outer diameter of the U-shaped member 20. The cross member 30 may include a round or oval cross-section to cooperate with a platform which may extend the substantial width of the cross member 30 and which may be angled with respect to the horizontal and may form a 45° angle with respect to the horizontal to facilitate a foot of the user/patient and may be formed from plastic or metal and may be attached through welding or other fasteners to provide a place for the patient to rest the foot of the patient. The cross-member 30 may be preferably coated with a non-slip surface 32 to prevent a user's foot from slipping off of the cross-member during use. The cross-member 30 may be adjustably affixed to the U-shaped member 20 through a pair of tubular attachments 40 which may be round.

Figure 2:
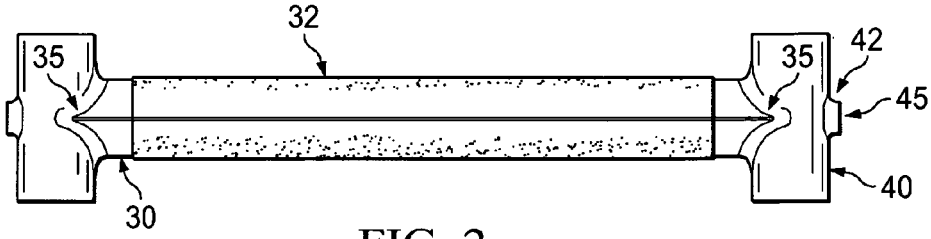
FIG. 2 is a side perspective view of a cross-member according to the present invention.
Figure 3:
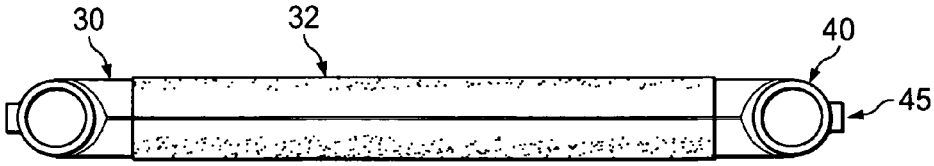
FIG. 3 is a top perspective view of a cross-member according to the present invention.

FIGS. 2 and 3 show perspective views of the cross-member 30 with tubular attachments 40. The tubular attachment 40 may be preferably formed from hollow tubing and may be constructed from a metal such as steel or aluminum, wood, or a rigid plastic, and may have an inner diameter sufficient to fit snuggly around the distal ends 24 of the U-shaped member 20. The cross-member 30 may be permanently affixed to the tubular attachments 40, preferably by a weld 35. A hole may be drilled through the side of the tubular attachment 40 opposite the connection point of the cross-member 30. A fastening device which may be a nut 45 which may be steel or other type of metal may be attached or welded by weld 42 to the attachment 40 such that the hole of the nut 45 may be in communication with the drilled hole on the attachment 40. A knob (not shown) may be threaded into the welded nut 45. When tightened into the nut 45, the threaded knob applies pressure to the outer wall of the U-shaped member. The applied pressure holds the cross-member 30 in place and prevents it from slipping when in use.

Figure 7:
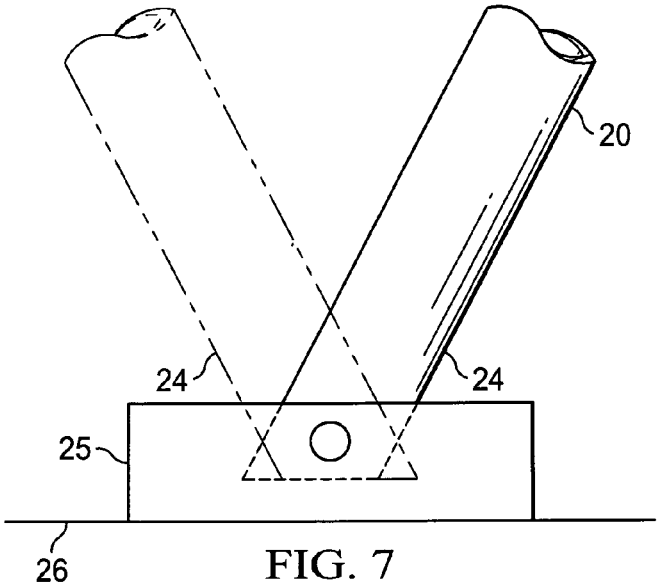
FIG. 7 illustrates an alternate foot embodiment.

FIG. 7 illustrates a pivoting foot member 25 which may pivot with respect to the distal end 24 of the U-shaped member 20. The pivoting foot member 25 may remain stationary with respect to the support surface 26 as the distal end 24 of the U-shaped member 20 rotates in order to provide improved traction with the support surface 26.

Figure 8:
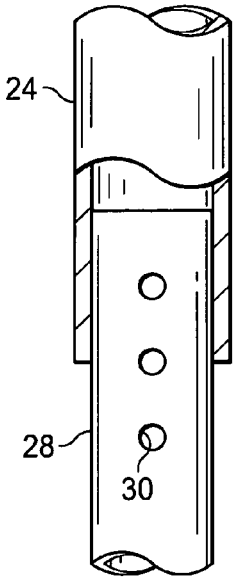
FIG. 8 illustrates an alternate foot embodiment.

FIG. 8 illustrates a telescoping leg member 28 which may be adjustable and extend from the distal end 24 of the U-shaped member 20. The telescoping leg member 28 may include a spring-loaded depressible and releasable pin 30 which may cooperate with an aperture through the distal end 24 to secure and release the telescoping leg member 28 from the distal end 24. This allows the height of the U-shaped member 20 to be adjusted.

Figure 4:
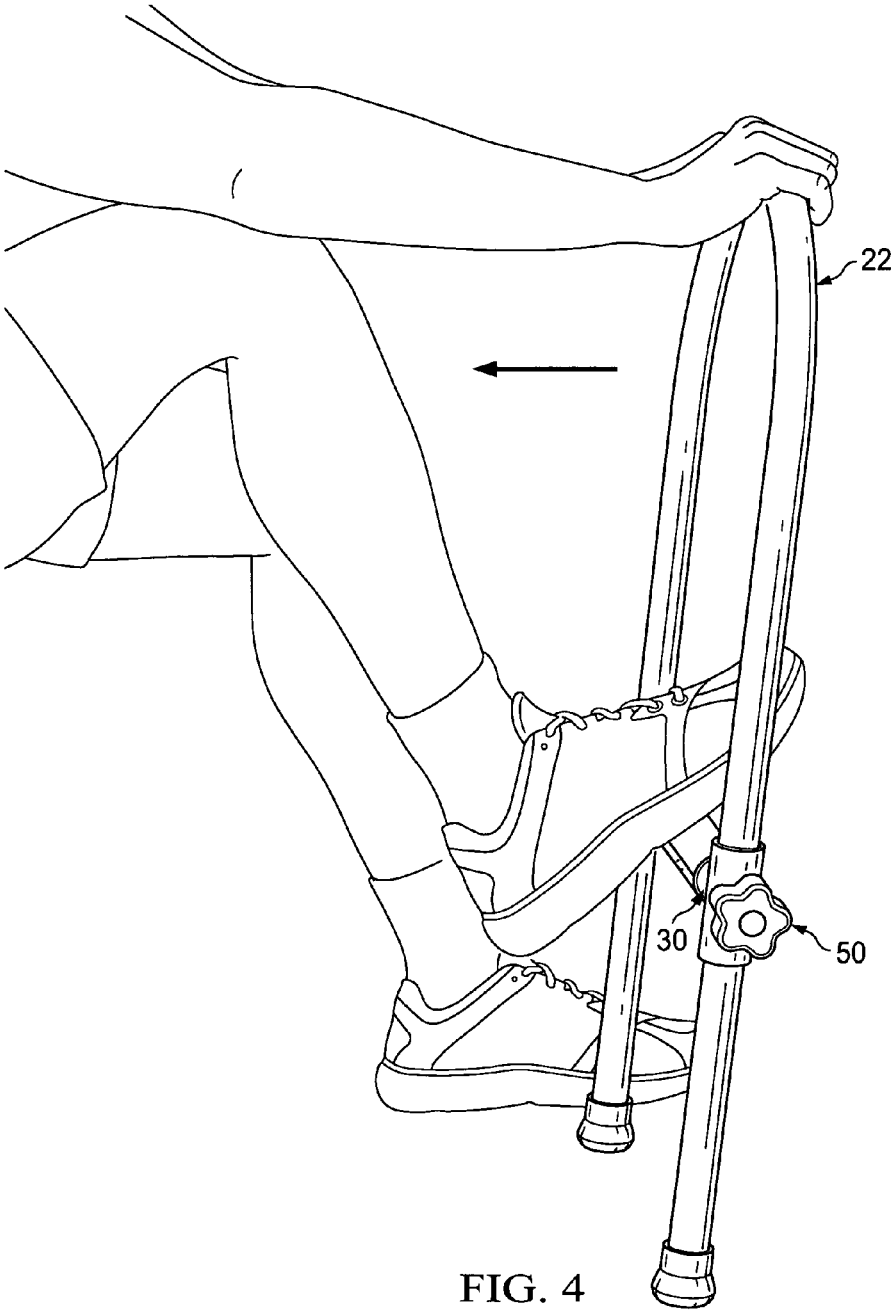
FIGS. 4 through 6 illustrate a preferred application of the present invention.
Figure 5:
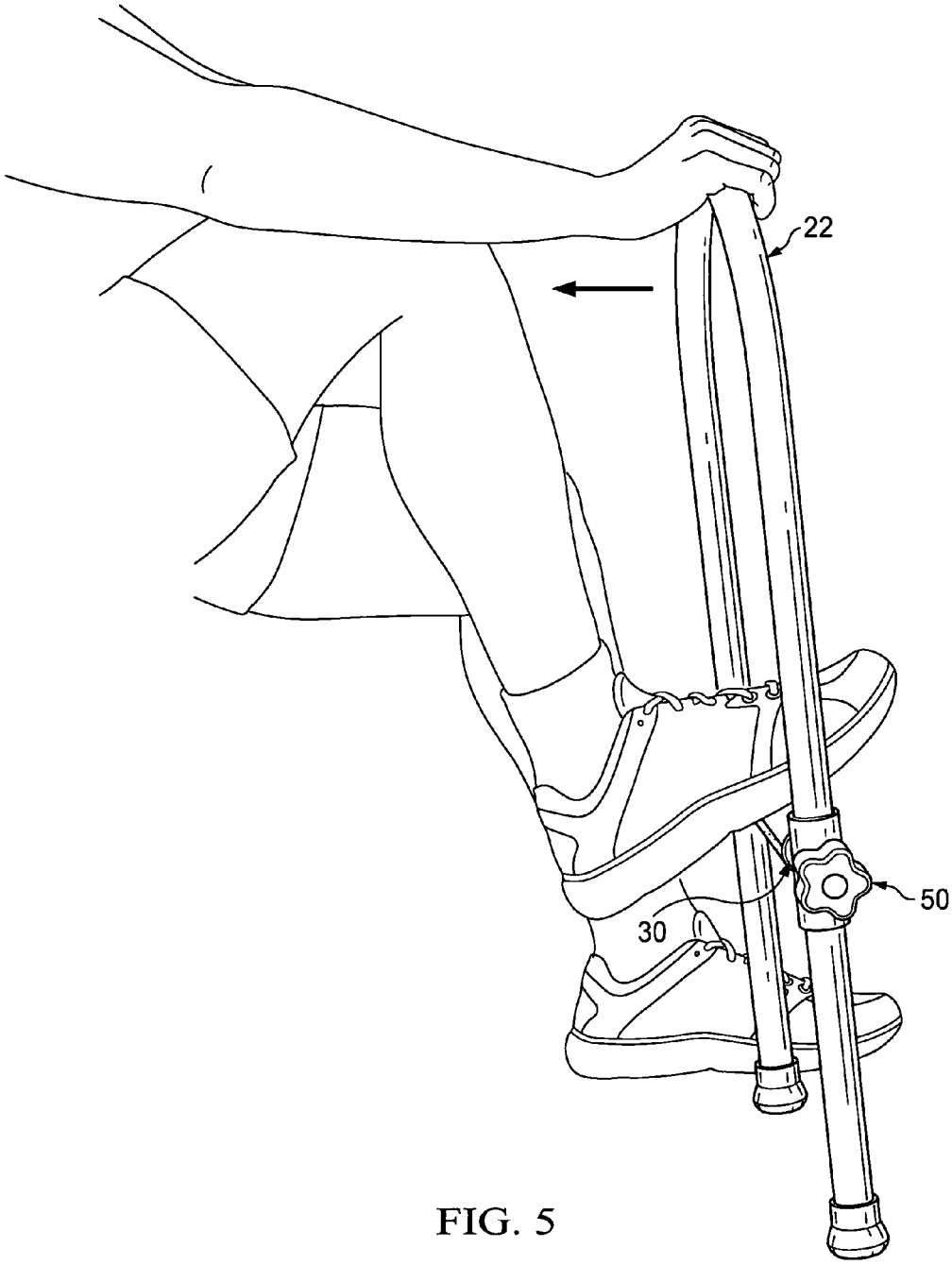
Figure 6:
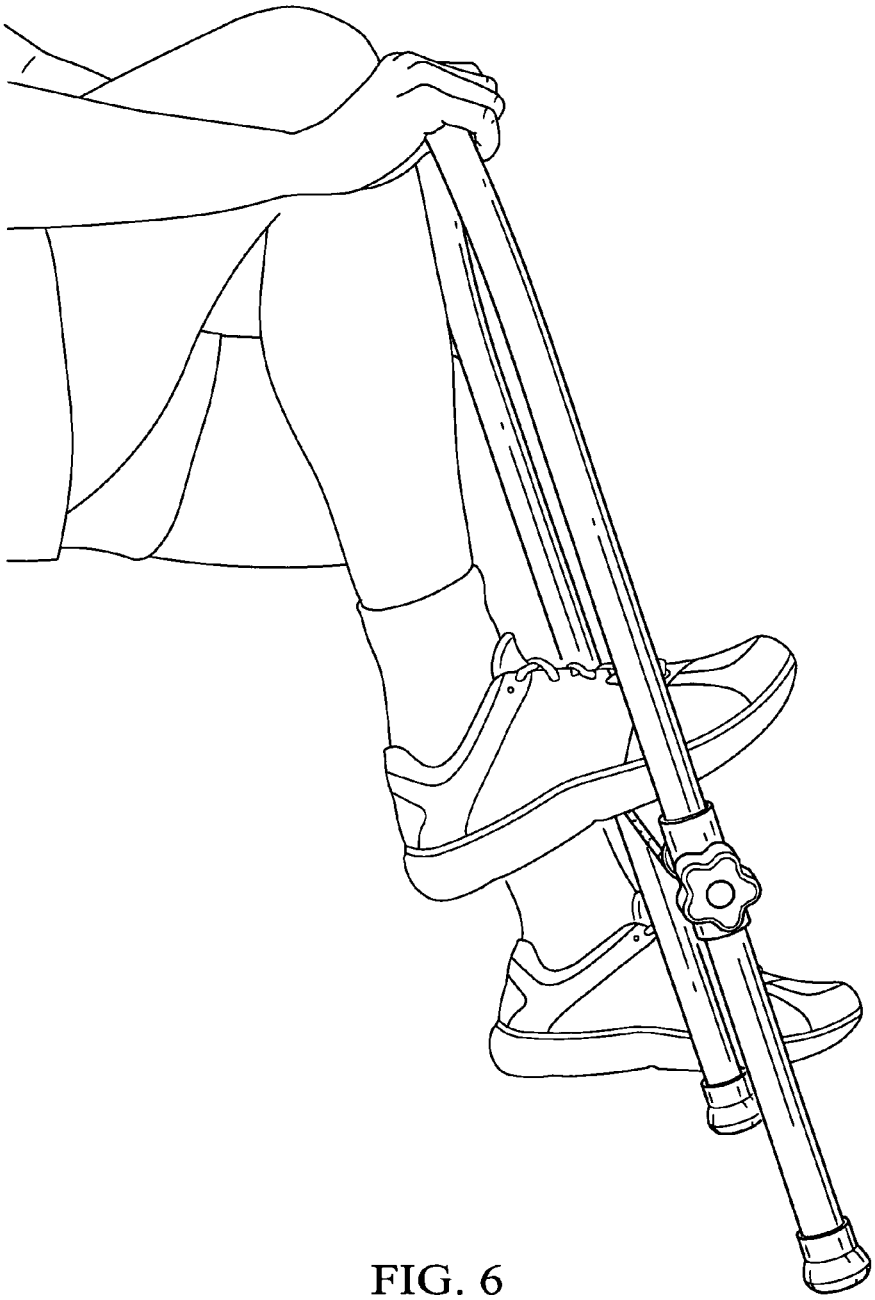

FIGS. 4 through 6 illustrate a preferred application of the present invention. In operation, a user may place the ball of his or her foot on the middle of the cross-member 30. The user then may place one or both hands on the handle portion 22 and slowly may pull the handle portion 22 toward his or her knee until the knee is properly stretched (as shown using the dashed arrow).

The proper stretch may be a moderate intensity stretch wherein the user will feel some discomfort and a pulling feeling in the knee. Stretching too far may cause pain and the user to reflexively withdraw from the motion. The user may control the speed and degree of pivoting of device 10, which may directly correlate to the motion of cross-member 30. Manual control of the device may allow for careful manipulation of the speed of flexing and the overall range of knee motion. Position of the cross-member 30 is adjusted using a pair of threaded knobs 50. The position of the cross-member 30 may impact the excursion of the foot backward and hence the bend in the knee. Raising the height of the cross-member 30 (i.e from close to the terminus of the distal ends and the floor, to closer to the handle end and further from the floor) may increase the difficulty of the exercise by increasing the knee angle if the distance of the device from the user remains constant. Alternatively, the user can "walk" the device closer to his or her body. "Walking" entails the user lifting on distal end and replacing it on the floor closer to his or her body. He or she then repeats the process on the other distal end. When a user is able to easily pull the handle to his or her knee (as shown in FIG. 6), it is time to "walk" the device closer to the body. This allows the user to maintain the continuity of the exercise and increase the difficulty without the added need of having to change the cross-member height.

The invention being thus described, it will be evident that the same may be varied in many ways. Such variations are not to be regarded as a departure from the spirit and scope of the invention and all such modifications are intended to be included within the scope of the claims.

What is claimed is:

1. An apparatus for flexing the knee comprising:

(a) a substantially U-shaped bar having two substantially straight arms each having a distal end and a curved handle portion connected to said straight arms; and (b) a substantially perpendicular cross-member adjustably attached to said straight arms and wherein said cross-member has a square cross section and wherein said cross-member is adjusted using a pair of threaded knobs.

2. The apparatus of claim 1 wherein the cross-member is coated with a non-slip material.

3. The apparatus of claim 1 wherein each distal end is capped with a skid-resistant material.

4. The apparatus of claim 3 wherein the skid-resistant materials is rubber.

5. An apparatus for flexing the knee comprising:

(a) an H-shaped bar having two roughly parallel straight arms each having a distal end and a curved handle portion; and (b) a perpendicular cross-member adjustably attached to said straight arms and wherein said cross-member has a square cross section and wherein said cross-member is adjusted using a pair of threaded knobs.

6. The apparatus of claim 1 wherein said cross-member is detachably connected by using a pair of threaded knobs.

* * * * *